US007562544B2

(12) United States Patent
Chang

(10) Patent No.: US 7,562,544 B2
(45) Date of Patent: Jul. 21, 2009

(54) DRUM WASHING MACHINE

(75) Inventor: Jae Won Chang, Kunpo-shi (KR)

(73) Assignee: LG Electronics Inc., Seoul (KR)

( * ) Notice: Subject to any disclaimer, the term of this patent is extended or adjusted under 35 U.S.C. 154(b) by 729 days.

(21) Appl. No.: 10/361,564

(22) Filed: Feb. 11, 2003

(65) Prior Publication Data

US 2004/0025545 A1 Feb. 12, 2004

(30) Foreign Application Priority Data

Aug. 9, 2002 (KR) ..... 10-2002-0047150

(51) Int. Cl.
*D06F 37/04* (2006.01)
*D06F 37/20* (2006.01)

(52) U.S. Cl. ..... 68/23.1; 68/23.3

(58) Field of Classification Search ..... 68/23.1
See application file for complete search history.

(56) References Cited

U.S. PATENT DOCUMENTS

| | | | | | |
|---|---|---|---|---|---|
| 3,247,689 | A * | 4/1966 | Wasemann | 68/23.3 |
| 3,509,742 | A * | 5/1970 | Bauer | 68/23.1 |
| 3,583,182 | A * | 6/1971 | Matsuura et al. | 68/23.1 |
| 3,703,091 | A * | 11/1972 | Steele | 68/23.1 |
| 3,856,200 | A * | 12/1974 | Leib | 494/82 |
| 3,922,892 | A * | 12/1975 | Leib | 68/23.3 |
| 4,403,484 | A * | 9/1983 | Fey et al. | 68/23.3 |
| 4,991,412 | A * | 2/1991 | Bauer et al. | 68/23.1 |
| 5,657,649 | A * | 8/1997 | Lim | 68/23.3 |
| 5,946,947 | A * | 9/1999 | Lee et al. | 68/23.3 |
| 5,975,972 | A * | 11/1999 | Wilmsen | 440/111 |
| 6,009,730 | A * | 1/2000 | Lee | 68/23.3 |
| 6,336,348 | B1 * | 1/2002 | Lee et al. | 68/12.27 |
| 6,574,997 | B1 * | 6/2003 | Mayer et al. | 68/23.1 |
| 2004/0016266 | A1 * | 1/2004 | Hisano | 68/23.1 |

FOREIGN PATENT DOCUMENTS

| | | | |
|---|---|---|---|
| CN | 1354809 | | 6/2002 |
| CN | 1463311 | | 12/2003 |
| DE | 2912673 | A * | 3/1980 |
| DE | WO 00/68488 | | 11/2000 |
| GB | 1123208 | | 8/1968 |
| GB | 1520383 | | 8/1978 |
| GB | 2 103 756 | | 6/1982 |
| GB | 2103756 | A | 2/1983 |
| JP | 4-220291 | | 8/1992 |
| JP | 4220291 | * | 8/1992 |
| JP | 4-244195 | | 9/1992 |
| JP | 9-187596 | | 7/1997 |
| WO | WO 00/68488 | | 11/2000 |

* cited by examiner

*Primary Examiner*—Michael Barr
*Assistant Examiner*—Jason P Riggleman
(74) *Attorney, Agent, or Firm*—Ked & Associates LLP

(57) ABSTRACT

A drum washing machine is disclosed, in which a damper is not directly fixed to a cabinet but has an elastic member as an intermediate to be fixed to the cabinet. Accordingly, vibrations of the damper are absorbed to vibrations of the elastic member without being directly delivered to the cabinet and also, during transient vibration of the drum, the damper acts to attenuate the transient vibration as the amplitude of the elastic member is limited by the action of the upper and lower limiters.

12 Claims, 7 Drawing Sheets

DRUM WASHING MACHINE

This application claims the benefit of the Korean Application No. P2002-47150 filed on Aug. 9, 2002, which is hereby incorporated by reference.

BACKGROUND OF THE INVENTION

1. Field of the Invention

The present invention relates to a drum washing machine.

2. Background of the Related Art

A washing machine removes laundry dirt and stains using chemical decomposition and mechanical impact through washing, rinsing, and dewatering processes. Generally, there are three types of washing machines: a pulsator washing machine, an agitator washing machine, and a drum washing machine.

Among them, the drum washing machine being provided with a drum having a plurality of projections performs a washing process by slowly and horizontally rotating the drum with a detergent, washing water, and a laundry object in it. In this way, in the drum washing machine, the washing process is performed by impact and frictional force being generated as the laundry is raised and dropped by the projections.

In the drum washing machine, a damage rate of a laundry is lowered and the amount of water for a washing process is saved. Accordingly, the drum washing machine with these advantages is being more widely used.

A general structure of a drum washing machine will be briefly described in reference to FIG. 1.

As shown in FIG. 1, a tub 2 is provided inside a cabinet 1 forming an external case. A drum 3 is rotatably formed on a central part inside the tub 2. A motor 4 is formed on one side of a lower part of the tub 2 and the motor 4 is coupled to a pulley 41 by a shaft. A drum shaft 32 having a drum pulley 31 is formed on a rear part of the drum 3. A belt 5 connects the drum pulley 31 and the motor pulley 41 to each other.

A door 6 is formed on the front part of the cabinet 1 and a gasket 7 is formed between the door 6 and the tub 2.

Also, a hanging spring 9 supporting the tub 2 is formed between two sides of the inner side of an upper face of the cabinet 1 and an upper part of an outer circumferential face of the tub 2.

A damper 8 is formed between two edges of a lower face of the cabinet 1 and two sides of a lower part of the outer circumferential face of the tub 2. The damper 8 absorbs and attenuates vibrations of the tub 2, generated as the drum 3 rotates in a dewatering process.

As shown in FIG. 2, a lower end of the damper 8 is fixed between brackets 12 on a base face 11 of the cabinet 1 by fastenings such as bolts 13 and nuts 14.

In the meantime, the most common problem of the drum washing machine is transient vibration of the drum 3. When the drum 3 is rotated with increasing speed as a dewatering process starts, the transient vibration are generated because of an uneven distribution of laundry load. The damper 8 may be designed bigger to reduce the transient vibration, but in that case, the vibration problem is caused during rated revolution instead.

On the contrary, if the damper is designed to be smaller, the vibration becomes smooth during the rated revolution for dewatering but the transient vibration problem is raised.

The transient vibration generates unpleasant noise and a disorder of component parts and thus, may reduce the lifetime of the washing machine.

SUMMARY OF THE INVENTION

Accordingly, the present invention is directed to a drum washing machine that substantially obviates one or more of the problems due to limitations and disadvantages of the related art.

An object of the present invention is to provide a drum washing machine in which vibrations of a cabinet, being generated as a tub vibrates, are minimized as a connection structure between a damper and the cabinet is improved.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a drum washing machine of the present invention includes a cabinet, a drum, a tub, a damper, and an elastic member. The drum is rotatably provided in the cabinet. The tub is provided in the cabinet for surrounding an outer surface of the drum. A damper is provided between the cabinet and the tub to reduce vibrations of the tub. The elastic member connects one end of the damper to the cabinet and elastically vibrates when the vibrations of the tub are delivered through the damper.

A limiting device may be further included to limit a range of up and down vibrations of the elastic member.

The elastic member may be formed of a plate. At least one bracket is provided on central portions on an upper surface of the elastic member and one end of the damper is fixed to the bracket.

In the first embodiment of the present invention, a groove is formed on a base face of the cabinet. And the elastic member elastically vibrates on the groove with both ends thereof being supported on the base face of the cabinet.

The limiting device of the first embodiment of the present invention includes extension parts and upper and lower limiters. The extension parts extending from both upper ends of the fixing member, facing each other, are formed. The upper limiters are provided on a lower part of the extension part, respectively. The lower limiter is provided on the bottom face of the groove.

The upper and lower limiters are formed of a rubber. The lower limiter may be provided on a central portion on the bottom face of the groove. The lower limiters may be provided on two different portions on the bottom face of the groove.

A height difference between the upper and lower limiters is formed to be greater than the maximum amplitude of the elastic member during the rated revolution of the drum but to be smaller than the minimum amplitude of the elastic member during the transient vibration of the drum.

In the second embodiment of the present invention, a plurality of projections are formed in a cabinet. The elastic member elastically vibrates with both ends thereof being supported on the projections. At this time, a fixing member may be further included to fix the ends of the elastic member on the projections.

The limiting device of the second embodiment of the present invention includes an extension parts and upper and lower limiters. The extension parts extending formed both upper ends, facing each other, of the fixing member 104 are formed. The upper limiters are provided on a lower part of each extension part. The lower limiter is provided on the cabinet between the projections.

The upper and lower limiters are formed of rubber. The lower limiter may be provided on a central portion on the cabinet between the projections. The lower limiters may be provided on two different portions on the cabinet between the projections.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
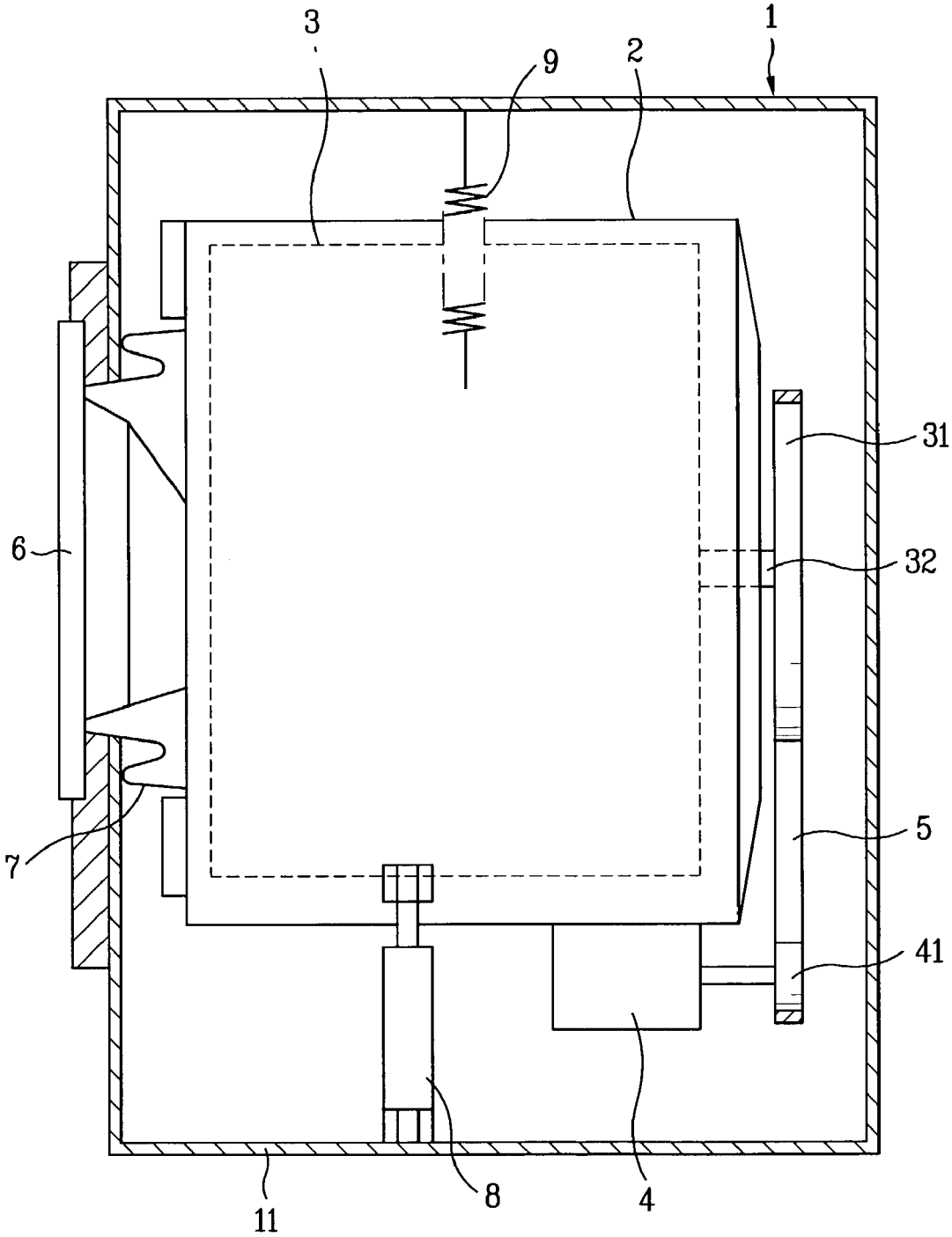
FIG. 1 Prior Art
FIG. 1 is a simplified plane view illustrating an internal structure of a drum washing machine of the related art.
Figure 2:
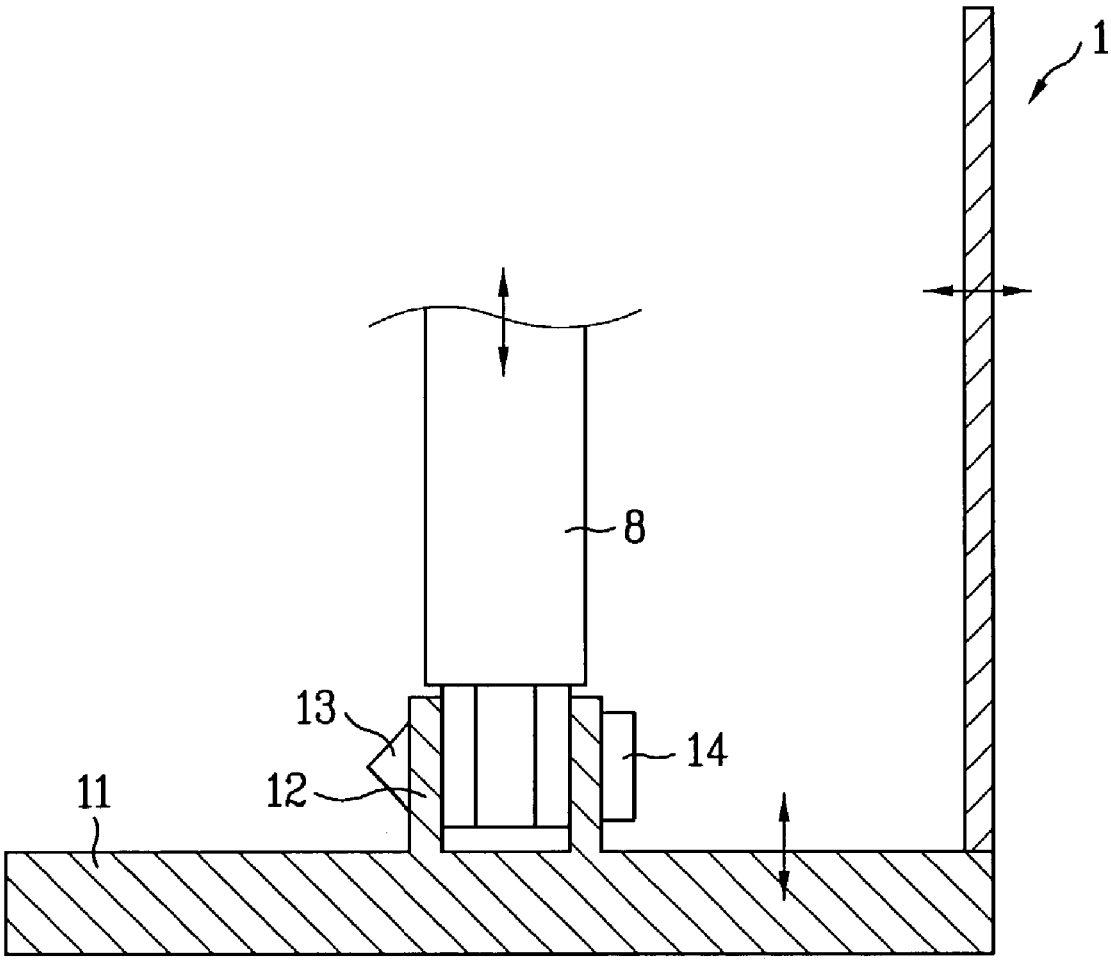
FIG. 2 Prior Art
FIG. 2 is a simplified plane view illustrating the damper and cabinet of FIG. 1, being coupled together.

Reference will now be made in detail to the preferred embodiments of the present invention, examples of which are illustrated in the accompanying drawings.

A drum washing machine of the present invention includes a cabinet 1, a drum 3, a tub 2, a damper 8, an elastic member 102, and a limiting device. The cabinet 1 forms an outer case of the drum washing machine. The drum 3 is rotatably provided in the cabinet 1. The tub 2 is provided in the cabinet 1 to surround an outer surface of the drum 3. The damper 8 is provided between the cabinet 1 and the tub 2 to attenuate vibrations of the tub 2. The elastic member 102 connects one end of the damper to the cabinet 1 and, by elastically transforming itself and vibrating, reduces the vibrations of the tub 2 when the vibrations are delivered to it through the damper 8. The elastic member 102 is made of steal or plastic. The limiting device controls a range of vibrations of the elastic member 102.

As shown in FIGS. 3 and 4, the present invention can be realized in a plurality of embodiments according to different coupling structures of the elastic member 102, the limiting device, the damper 8, and the cabinet 1.

First Embodiment

Figure 3A:
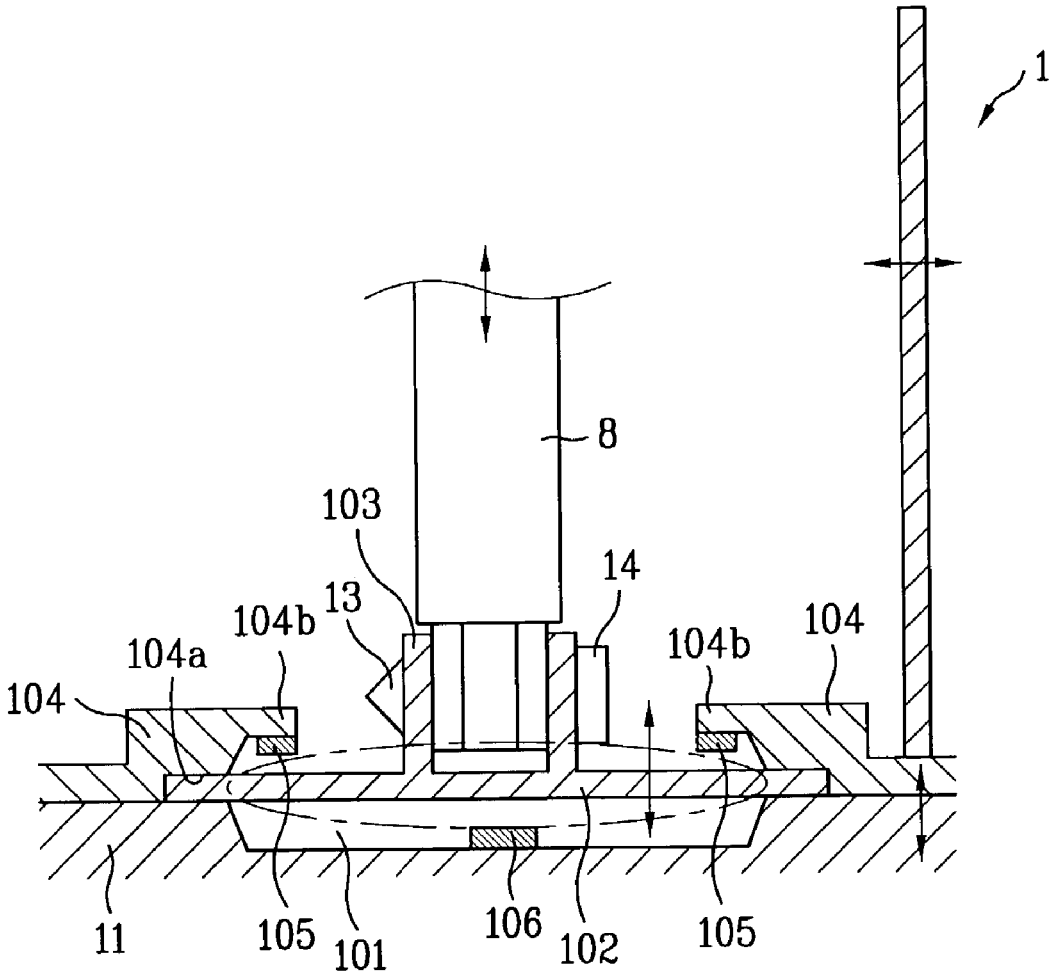
FIGS. 3A and 3B are simplified views illustrating damper and cabinet being coupled together in accordance with the first embodiment of the present invention.
Figure 3B:
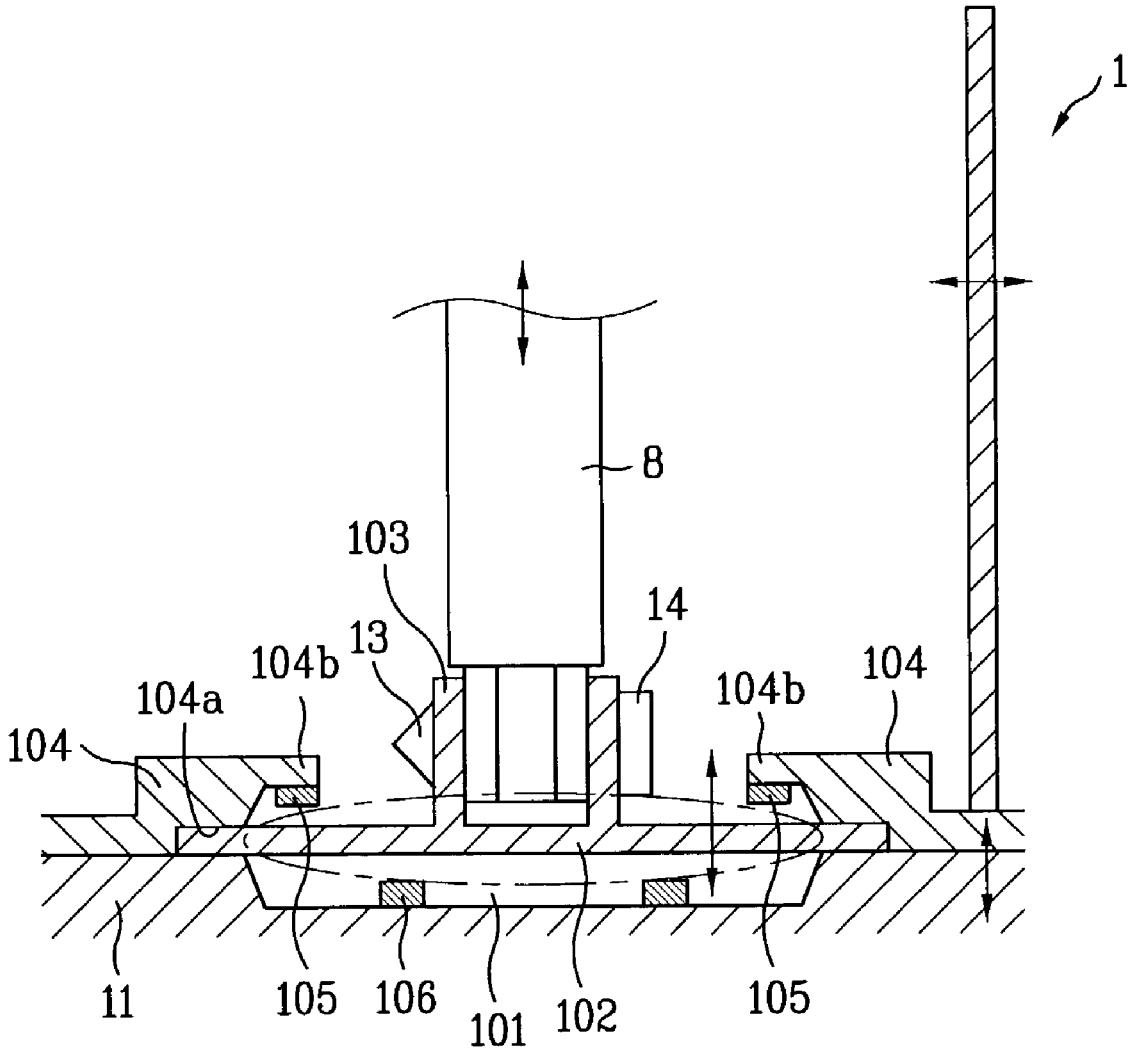

Referring to FIGS. 3A and 3B, an elastic member 102 is formed of a plate. Two brackets 103 projecting from central portions on the upper surface of the elastic member 102 are provided to face each other. One end of a damper 8 is inserted between the two brackets 103 and fastened by bolts 13 and nuts 14.

A groove 101 with predetermined depth is formed on a base surface 11 of the cabinet 1 and the elastic member 102 is formed over the groove 101 with its both ends put on the upper faces of the cabinet 1 as shown in FIG. 3.

At this time, a fixing member 104 is provided to fix each edge of the elastic member 102. A small-sized fixing groove 104*a* is formed on a lower part of the fixing member 104, so that one end of the elastic member 102 can be inserted thereto so to be supported. After one end of the elastic member 102 is inserted to the fixing groove 104*a*, the fixing member 104 is fixed onto the base face 11 of the cabinet 1. The fixing member 104 may be fixed by being welded or by being fastened by such fastenings as bolts, nuts, or screws.

The limiting device includes extension parts 104*b*, an upper limiter 105, and a lower limiter 106. As shown in FIG. 3, the extension parts 104*b* extending from both upper ends of the fixing member 104, facing each other, are formed. The upper limiter 105 is provided on a lower part of the extension part 104*b* to limit a range of upward vibrations of the elastic member 102. The lower limiter 106 for limiting a range of downward vibrations of the elastic member 102 is provided either on the central portion of the bottom face of the groove 101 as shown in FIG. 3A or on two different portions of the bottom face of the groove 101 as shown in FIG. 3B.

Preferably, The upper and lower limiters 105 and 106 are formed of such materials as a rubber having an excellent shock absorbing capability so that shocks being generated when the upper and lower limiters 105 and 106 contact the elastic member 102 can be relieved.

A height difference between upper and lower limiters 105 and 106 is formed to be greater than the maximum amplitude of the elastic member 102 during the rated revolution of the drum 3 but smaller than the minimum amplitude of the elastic member 102 during the transient vibration of the drum 3.

Second Embodiment

Figure 4A:
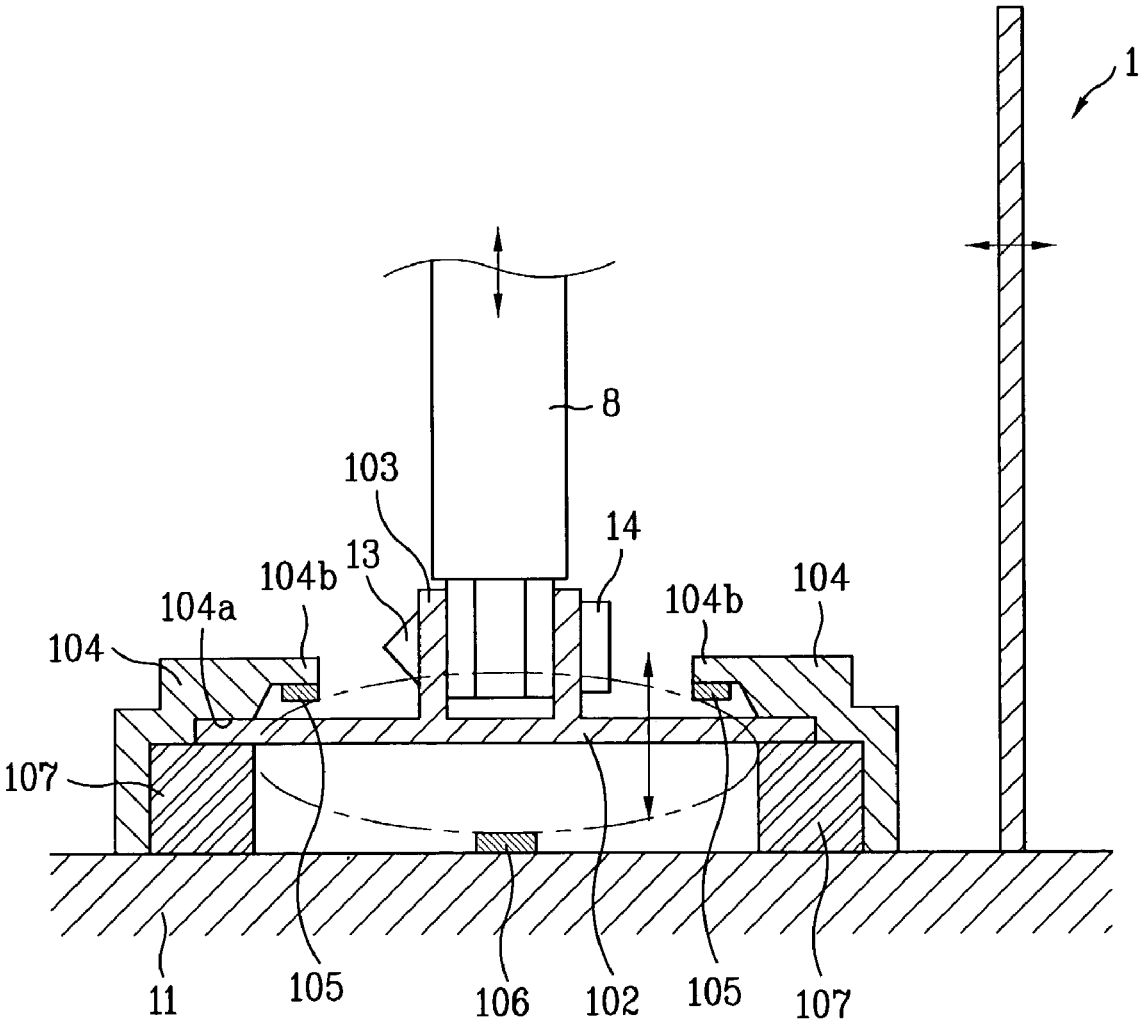
FIGS. 4A and 4B are simplified views illustrating damper and cabinet being coupled together in accordance with the second embodiment of the present invention.
Figure 4B:
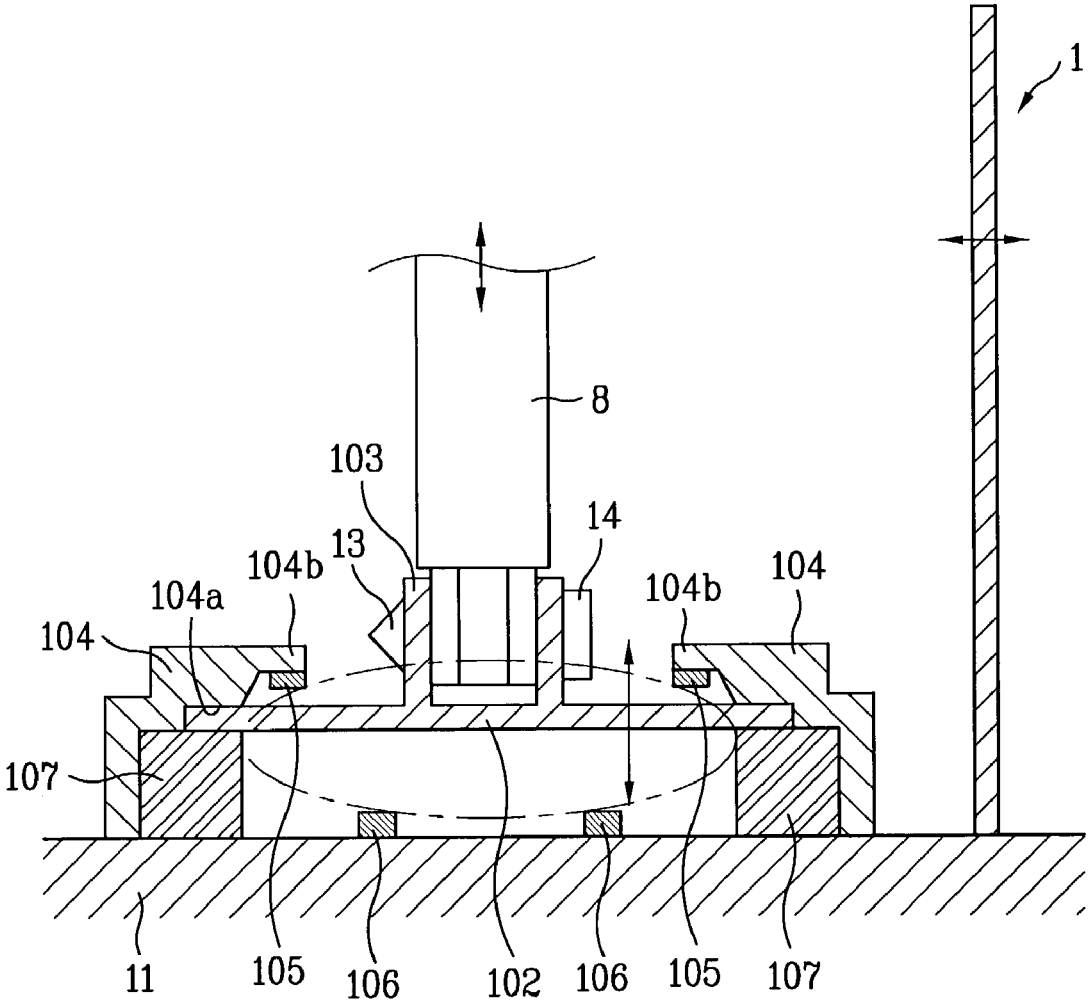

Referring to FIGS. 4A and 4B, an elastic member 102 is formed of a plate. Two brackets 103 projecting from two different central portions of the upper surface of the elastic member 102 are formed to face each other. One end of a damper 8 is inserted between the two brackets 103 and fastened by bolts 13 and nuts 14.

A plurality of projections are formed in a cabinet 1. An elastic member 102 is placed on the projections with its both ends put on the upper faces of the projections.

At this time, a fixing member 102 may be further included to fix the ends of the elastic member onto the projections. A small-sized fixing groove 104*a* is formed on a lower part of the fixing member 104 so that one end of the elastic member 102 can be inserted thereto so to be supported. After one end of the elastic member 102 is inserted to the fixing groove 104*a*, the fixing member 104 is fixed onto the projections 107. The fixing member 104 may be fixed by being welded or by being fastened by such fastenings as bolts, nuts, or screws.

The limiting device includes an extension part 104*b* and upper and lower limiters 105 and 106. The extension parts 104*b* extending from both upper ends of the fixing member 104, facing each other, are formed. The upper limiter 105 is provided on a lower part of the extension part 104*b* to limit a range of upward vibrations of the elastic member 102. The lower limiter 106 for limiting a range of downward vibrations of the elastic member 102 is provided either on a central portion of the cabinet between the projections 107 as shown in FIG. 4A or on two different portions on the cabinet 1 between the projections 107 as shown in FIG. 4B.

A height difference between upper and lower limiters 105 and 106 is formed to be greater than the maximum amplitude of the elastic member 102 during the rated revolution of the drum 3 but to be smaller than the minimum amplitude of the elastic member 102 during the transient vibration of the drum 3.

The following is a description on how the vibrations in the first and second embodiments are attenuated.

Figure 5:
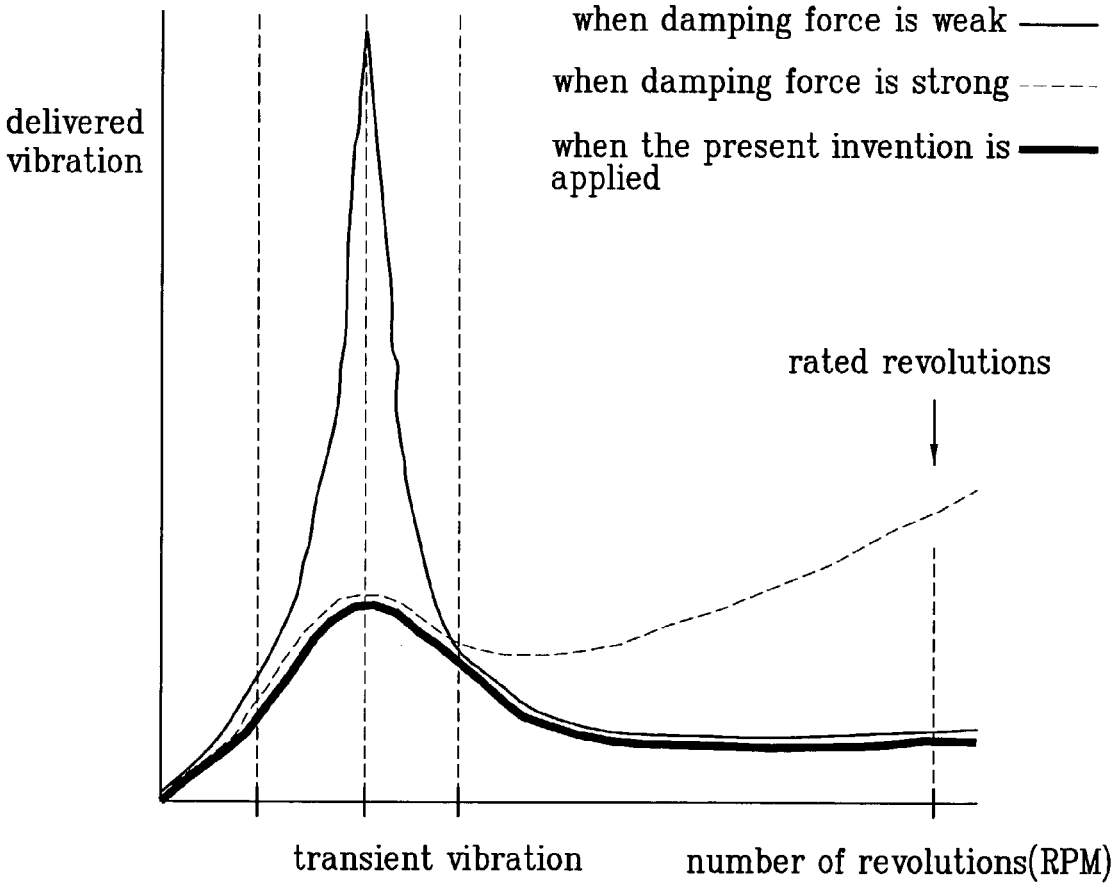
FIG. 5 is a graph illustrating a vibration property of a drum washing machine in accordance with the present invention.

Referring to FIGS. 3 to 5, during washing and dewatering processes, a tub 2 vibrates up and down as a drum 3 starts rotating. Then, the vibrations are delivered to a damper 8 being coupled to a lower part of the tub 2 and thus, an elastic member 102 comes to vibrate as well.

When the vibrations of the drum 3 are weak, the tub 2 is supported only by a spring 9 without any action of the damper 8. At this instance, the elastic member 102 being provided with the weak vibrations of the tub 2 starts vibrating between upper and lower limiters 105 and 106, thereby attenuating the vibrations of the tub 2.

If load of a laundry is unevenly distributed in the drum 3, however, transient vibration is generated by the uneven distribution of the load during the early rotation process of the drum 3. In this case, the amplitude of the elastic member 102 is increased to the extent that the amplitude becomes greater than the height difference between the upper and lower limiters 105 and 106. Accordingly, the elastic member 102 comes in contact with the upper and lower limiters 105 and 106 so as to be supported, and in this way, the amplitude of the elastic member 102 is limited. As described above, when the amplitude of the elastic member 102 is limited by the upper and lower limiters 105 and 106, the damper 8 performs a function of attenuating the vibrations of the tub 2.

In the meantime, during rated revolution of the drum 3, the elastic member 102 vibrates between the upper and lower limiters 105 and 106 without contacting them and the elastic member 102 itself absorbs the vibrations of the tub 2 without any action of the damper 8. This is because that the amplitude of elastic member 102 is formed to be smaller than the height difference between the upper and lower limiters 105 and 106 during the rated revolution.

In the present invention, the damper is not directly fixed to the cabinet but has an elastic member as an intermediate to be fixed to the cabinet. Accordingly, the vibrations of the damper are absorbed to the vibrations of the elastic member without being directly delivered to the cabinet. Also, during the transient vibration, because the amplitude of the elastic member is limited by the action of the upper and lower limiters, the damper attenuates the transient vibration. Therefore, as shown in FIG. 5, in the drum washing machine of the present invention, the vibration and noise problems are improved not only during the transient vibration period but also during the rated revolution process.

Also, the lifetime of the drum washing machine is extended as component parts of it are prevented from being early broken down.

It will be apparent to those skilled in the art that various modifications and variations can be made in the network system and method for making communication in the network system of the present invention without departing from the spirit or scope of the invention.

For example, the present invention can be realized in a modified embodiment in which the first and second embodiments are applied together. In other words, in this modified embodiment, a groove is formed on the bottom face of the cabinet and a plurality of projections are formed on two portions of the groove while an elastic member vibrates in a state that each edge of it is fixed to the projections.

Also, as for the elastic member, a compression spring moving up and down may be used as well as a plate.

Thus, it is intended that the present invention cover the modifications and variations of this invention provided they come within the scope of the appended claims and their equivalents.

What is claimed is:

1. A drum washing machine, comprising:

a cabinet;

a drum rotatably provided in the cabinet;

a tub provided in the cabinet and configured to surround an outer surface of the drum;

a damper including a first end directly coupled to the tub and a second end;

an elastic member connecting the second end of the damper to the cabinet, the elastic member including end portions fixed to the cabinet by fixing members and a central portion that extends between the end portions and spaced apart from a base of the cabinet, wherein the central portion elastically supports the second end of the damper and vibrates between the end portions along an axis of the damper to reduce a vibration of the tub;

a limited device configured to limit a range of up and down vibrations of the elastic member; and a groove formed on the vase of the cabinet to enable the elastic member to be vibrated on a space defined by the groove with both ends of the elastic member being supported on the base of the cabinet, wherein the elastic member is formed of a plate, wherein the central portion of the elastic member includes at least one bracket provided thereon to connect the end of the damper to the elastic member, wherein the end portions of the elastic member are directly fixed on the base of the cabinet by the fixing members, and wherein the limiting device comprises:

extension parts extending from upper ends of the fixing members, facing each other;

upper limiters being provided on a lower part of the extension parts; and at least one lower limiter being provided on a bottom face of the groove.

2. The drum washing machine of claim 1, wherein the upper and lower limiters are formed of a rubber.

3. The drum washing machine of claim 1, wherein the lower limiter is provided on a central portion on the bottom face of the groove.

4. The drum washing machine of claim 1, wherein the lower limiter comprises two lower limiters that are provided on two different portions, respectively, on the bottom face of the groove.

5. The drum washing machine of claim 1, wherein a height difference between the upper and lower limiters is formed to be greater than a maximum amplitude of the elastic member during a rated revolution of the drum.

6. The drum washing machine of claim 1, wherein a height difference between the upper and lower limiters is formed to be smaller than a maximum amplitude of vibration of the elastic member during a transient vibration of the drum.

7. A drum washing machine, comprising:

a cabinet;

a drum rotatably provided in the cabinet;

a tub provided in the cabinet and configured to surround an outer surface of the drum;

a damper including a first end directly coupled to the tub and a second end;

an elastic member connecting the second end of the damper to the cabinet, the elastic member including end portions fixed to the cabinet by fixing members and a central portion that extends between the end portions and spaced apart from a base of the cabinet, wherein the central portion elastically supports the second end of the damper and vibrates between the end portions along an axis of the damper to educe a vibration of the tub;

a plurality of projections that are formed on the base of the cabinet to enable the elastic member to be vibrated with both ends of the elastic member being supported on the projections; and a limiting device configured to limit a range of up and down vibrations of the elastic member, wherein the limiting device comprises:

extension parts extending from upper ends of the fixing members, facing each other;

upper limiters being provided on a lower part of each extension part; and at least one lower limiter provided on the base of the cabinet between the projections, wherein the end portions of the elastic member are fixed on the projections by respective fixing members, wherein the elastic member is formed of a plate, and wherein the central portion of the elastic member includes at least one bracket provided thereon to connect the end of the damper to the elastic member.

8. The drum washing machine of claim 7, wherein the upper and lower limiters are formed of rubber.

9. The drum washing machine of claim 7, wherein the lower limiter is provided on a central portion on the cabinet between the projections.

10. The drum washing machine of claim 7, wherein the lower limiter comprises two lower limiters that are provided on two different portions on the cabinet, respectively, between the projections.

11. The drum washing machine of claim 7, wherein a height difference between the upper and lower limiters is formed to be greater than a maximum amplitude of the elastic member during a rated revolution.

12. The drum washing machine of claim 7, wherein a height difference between the upper and lower limiters is formed to be smaller than a maximum amplitude of vibration of the elastic member during a transient vibration of the drum.

* * * * *